US005193365A

United States Patent [19]

Nelson

[11] Patent Number: 5,193,365

[45] Date of Patent: Mar. 16, 1993

[54] PENALTY DEVICE FOR CRIMINAL OFFENDERS

[76] Inventor: Gary T. Nelson, 21080 S. Cascaberry Ct., Oregon City, Oreg. 97045

[21] Appl. No.: 765,985

[22] Filed: Sep. 26, 1991

[51] Int. Cl.[5] ..... E05B 75/00

[52] U.S. Cl. ..... 70/16; 63/1.1; 63/11; 128/877; 602/21

[58] Field of Search ..... 70/16, 15, 17; 128/846, 128/877, 878; 602/20, 21; 119/126, 128; 63/3, 5.1, 11, 1.1, DIG. 3

[56] References Cited

U.S. PATENT DOCUMENTS

| | | | |
|---|---|---|---|
| 267,877 | 11/1882 | Gustaveson | 63/1.1 X |
| 349,696 | 9/1886 | Davis | 70/16 |
| 380,441 | 4/1888 | Hyatt et al. | 70/16 |
| 404,544 | 6/1889 | James et al. | 70/16 |
| 738,983 | 9/1903 | Burdick | 70/17 |
| 941,942 | 11/1909 | Nagle | 70/16 |
| 1,047,457 | 12/1912 | Steimer | 70/16 |
| 1,082,230 | 12/1913 | Nagle | 70/16 |
| 1,529,546 | 3/1925 | McKenzie | 70/16 |
| 2,020,279 | 11/1935 | Long | 340/304 |
| 2,106,849 | 2/1938 | Long | 70/16 |
| 3,189,073 | 6/1965 | Todd | 128/878 X |
| 4,741,051 | 3/1988 | Bible | 70/16 X |
| 4,813,745 | 3/1989 | Woody | 70/16 X |
| 4,949,957 | 8/1990 | Cucchiara | 602/21 X |
| 4,982,745 | 1/1991 | Shields | 128/877 |
| 5,031,641 | 7/1991 | Upton | 70/16 X |

FOREIGN PATENT DOCUMENTS

| | | | |
|---|---|---|---|
| 2108572 | 5/1983 | United Kingdom | 70/16 |

*Primary Examiner*—Lloyd A. Gall

[57] ABSTRACT

As an alernative to incarceration or supervised parole/-probation, and following the burgeoning home detention philsophy, the penalty device would provide a humane, relatively inexpensive, court directed, rehabilitative/monitoring measure for non-violent criminal offenders. The device would consist of a rigid sleeve of heavy gauge plastic or metal which is locked in place around a criminal offender's forearm by a locking mechanism. The penalty device would be a court ordered stipulation or unsupervised parole or probation. The device would not only constitute appropriate requital for many offenses, but would additionally serve to identify certain offenders to law enforcement personnel and the public in general.

1 Claim, 1 Drawing Sheet

PENALTY DEVICE FOR CRIMINAL OFFENDERS

BACKGROUND OF INVENTION

1. Field of the Invention

The present invention is an alternative to incarceration and an inexpensive device for humanely penalizing criminal offenders. Following the burgeoning home detention philosophy for principally non-violent criminal offenders, this device will permit effective punishment of offenders while easing jail overcrowding.

2. Description of Related Art

In 1990, there were reported to be nearly one million prisoners housed in Federal, State, and local institutions. By 2005, it is expected that two million prisoners will jam an already overcrowded system. This crisis in overcrowding has forced courts to release prisoners long before sentences have been served, often simply dumping offenders back into the streets for lack of appropriate alternate programs. Parole and probation departments are swamped and readily acknowledge their growing ineffectiveness in carrying out adequate supervision. The ambiguity of the current system and the uncertainty of punishment has without a doubt contributed to the startling recidivism rates.

Recently legislated sentencing reforms reflect more severe attitudes that seek to reduce disparity and uncertainty. However, taxpayers have recoiled at the tremendous, per prisoner, costs involved in funding sufficient facilities and traditional supervisory systems. The courts are faced with a paradox in which, on one hand, the public is clamoring for stiffer, more absolute penalties, but, on the other, appropriate programs to satisfy that mandate do not exist. To date, the answer has too often been the selling of an illusion - stiff sentences, but early releases. An armed robber is sentenced to twenty years in prison and then quietly released after serving nine months, relegated to a state of what in reality is unsupervised parole. Illegal drug dealers and users are diverted into rehabilitative programs in lieu of jail time, programs in which they have no interest or motivation to successfully complete. For lack of jail space, convicted drunk drivers repeatedly pay a fine, continuing to purchase liquor and drive even after several arrests; and in spite of being suspended and without insurance.

It is imperative that a system of penalties be provided that is consistent and predictable, providing sanctions congruent with the concept of "just deserts." The criminal justice system has utilized, even experimented with, various forms of non-incarceration punishment-/rehabilitation. The most widely used is, of course, parole and probation, the limitations of which were previously noted. Another, increasingly used technique is electronic home monitoring which, given the proper candidate and circumstances, has proven successful. There is, however, a growing backlash that EHM is too "user friendly," that it may well enable the monitoring of an offender's daily activities, but it does not incorporate sufficient restriction of activities or necessary social ostracism to be considered adequate measures for many offenses.

With the exception of the proposed device, no penalty device is known which is relatively humane, difficult to remove without detection, limiting in the sense that wearers would be readily identifiable and subjected to appropriate allied social ostracism and requital, but still allow a degree of freedom to move about in society, while at the same time identifying them as an alcohol or drug abuser, someone who should not be associating with children, or someone who is in a rehabilitative status that needs continuous monitoring.

SUMMARY OF THE INVENTION

The principal object of the present invention is to provide a realistic, inexpensive, effective penalty alternative to incarcerating non-violent criminal offenders.

It is also the object of the present invention to allow ready identification of certain categories of criminal offenders by law enforcement personnel, citizen action groups, school officials, bar and liquor store owners, and the public in general.

Another object is to provide a penalty for some criminal offenses that is relatively humane, but nonetheless constitutes appropriate and sufficient requital in that the implementation of its use would often deter future similar offenses by the offender.

The preceding objects can be accomplished by providing a penalty device consisting of a sleeve or sheath constructed of metal or other suitable materials that is slipped over the hand and fits loosely around an individual's forearm. The sleeve is secured in place using a locking band, a small chain or cable which connects the locking band to the sleeve, and a tamper resistant seal.

The preferred embodiment of the invention is a cone-shaped sleeve or sheath made of non-allergenic heavy gauge plastic, metal or similar material. The sleeve is slipped over the hand and secured in place with a custom fitted plastic, metal, or other similar material, locking band. The locking band fits around the wrist between the sleeve and the hand and is attached to the sleeve by a connecting chain. The chain prevents the sleeve from being slipped up and over the elbow where the sleeve might be more easily concealed in the biceps area. A protruding lip on the locking band and the chain prevents the sleeve from being slipped down and over the hand. The lip on the locking band also serves as the point at which the tamper resistant seal secures the band to the chain. The locking band clam-shells around the wrist and fits snugly enough that the band could not be removed without breaking the seal. It would be necessary, of course, to have numerous sizes of locking bands, and, to a lesser extend, various sleeve sizes.

The sleeve, or more specifically the cuff apparatus, would comprise a criminal penalty in lieu of incarceration, and would be one of the conditional requirements of unsupervised probation. If the sleeve was forcefully removed by the offender, or an accomplice, prior to completion of the probationary period, said removal would constitute a violation of probation with probable mandatory imprisonment.

The sleeve or cuff could be brightly colored to indicate a particular offense or emblazoned with letters spelling out the offense, or both.

DETAILED DESCRIPTION

Figure 1:
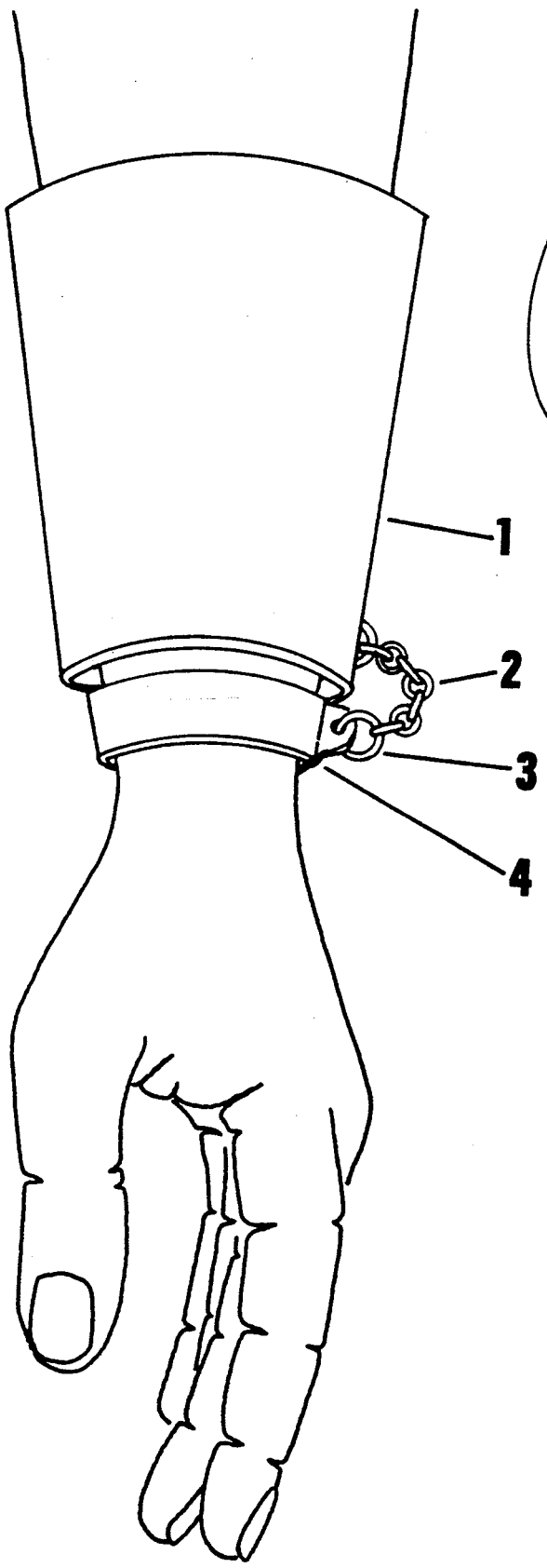
FIG. 1 is a side depiction of the penalty cuff in accordance with the present invention.
Figure 2:
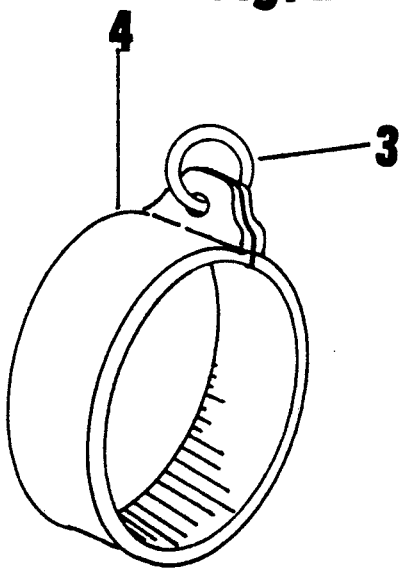
FIG. 2 is a frontal view of the locking band portion of the invention.

As shown in the drawings, the penalty device in accordance with the present invention includes: A heavy gauge plastic, metal, or other suitable material, sheath or sleeve (1) which is held in place by the locking band (4), and the connecting chain or cable (2). The connecting chain is attached to the locking band by a tamper resistant seal (3).

The hollow sleeve or sheath (1), approximately 6" (15 centimeters), in length is cone or funnel-shaped with the smaller end worn nearest the wrist. It is designed to be slipped over the hand and fit loosely around the forearm to allow free circulation of air, as well as to facilitate necessary hygiene such as washing or drying the forearm. It would be constructed of a non-allergenic, heavy gauge plastic, metal, or other suitable material which is not easily dented, bent, cut, or damaged. The looseness of fit also would serve to deter concealment of the device by those so inclined. Nonetheless, the sleeve would not prevent or impede movement of the arm to any significant degree.

The locking band (4) would be closely fitted to and clam-shelled around the individual wrist; fitted snugly enough to prevent removal of the locking band without creating evident damage to the seal (3). The locking band would be constructed of durable plastic or other suitable material. A protruding lip or nub area, where the band clamps together, allows the attachment of the seal, and is additional protection against the sleeve being slipped down and over the hand.

The connecting chain or cable (2) prevents the sleeve or sheath (1) from being slipped up or down the arm. Strength of the chain is important but not imperative. More importantly, efforts to damage, compromise, or separate the chain should be detectable.

A unique seal (3), designed to impede duplication and to expose tampering or compromising of the penalty device, secures the locking band (4) to the connecting chain (2) at the locking band's nub area. The connecting chain is permanently attached to the sleeve (1).

The described invention is an alternative to incarceration or supervised probation and is a relatively inexpensive device for humanely penalizing non-violent criminal offenders. As a stipulation of court directed unsupervised probation, the sleeve or sheath is slipped over the hand and locked in place for the duration of the unsupervised probationary period. Removal of the device by the convicted offender would constitute a violation of his/her probationary status.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A penalty device, an alternative to judicially directed incarceration or supervised parole/probation designed to temporarily identify criminal offenders, comprising a rigid, heavy gauge plastic or metal sheath or sleeve which is slipped over and past the hand and wrist, loosely fitted around the forearm, the sleeve of such length as to not restrict fundamental motion of the elbow, and prevented from removal by a clam shell type, flexible bracelet or locking band which is closely fitted around the wrist and locked in place using a tamper resistant seal designed to dissuade unauthorized or undetected removal of the locking band and sleeve, the sleeve and seal are linked by a short, permanently affixed cable or chain which prevents the sleeve from being slipped up the arm or down and over the locking band while the band is fastened in place.

* * * * *